US007198033B2

(12) United States Patent
Inaguma et al.

(10) Patent No.: US 7,198,033 B2
(45) Date of Patent: Apr. 3, 2007

(54) FUEL SUPPLY SYSTEM OF INTERNAL COMBUSTION ENGINE

(75) Inventors: Yoshitsugu Inaguma, Chita-gun (JP); Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 190 days.

(21) Appl. No.: 11/086,580

(22) Filed: Mar. 23, 2005

(65) Prior Publication Data

US 2005/0211224 A1 Sep. 29, 2005

(30) Foreign Application Priority Data

Mar. 26, 2004 (JP) ..... 2004-093776

(51) Int. Cl.
*F02M 37/04* (2006.01)

(52) U.S. Cl. ..... 123/506; 123/198 D; 123/446; 123/501

(58) Field of Classification Search ..... 123/506, 123/446, 500, 501, 198 D, 179.17, 359, 479
See application file for complete search history.

(56) References Cited

U.S. PATENT DOCUMENTS 5,094,216 A * 3/1992 Miyaki et al. ..... 123/506
5,603,303 A * 2/1997 Okajima et al. ..... 123/508
6,123,059 A 9/2000 Inaguma et al.
6,253,734 B1 * 7/2001 Rembold et al. ..... 123/446
6,345,608 B1 2/2002 Rembold et al.
6,446,609 B2 * 9/2002 Mizuno et al. ..... 123/479
6,447,273 B1 * 9/2002 Nishimura et al. ..... 417/505
6,655,362 B2 * 12/2003 Rembold et al. ..... 123/506
2004/0200456 A1 * 10/2004 Eser et al. ..... 123/458
2005/0045158 A1 * 3/2005 Takahashi ..... 123/506

FOREIGN PATENT DOCUMENTS

JP 10-61468 3/1998
JP 2001-182593 7/2001
JP 2001-241344 9/2001
JP 2001-304071 10/2001

* cited by examiner

*Primary Examiner*—Carl S. Miller
(74) *Attorney, Agent, or Firm*—Nixon & Vanderhye P.C.

(57) ABSTRACT

A high-pressure pump is formed with a secondary suction passage, which branches from a fuel suction passage and communicates with a pump chamber. Check valves for preventing a backflow of fuel are disposed respectively in the secondary suction passage and a discharge passage. An electromagnetic valve for regulating a fuel discharge quantity is disposed in the fuel suction passage. Normal control for controlling the fuel discharge quantity by controlling opening timing and closing timing of the electromagnetic valve with respect to reciprocating movement of a plunger is performed when an engine rotation speed is higher than a predetermined value during operation of an engine. Valve closing control for holding the electromagnetic valve at a closed state is performed when the engine rotation speed is equal to or lower than the predetermined value.

13 Claims, 13 Drawing Sheets

FUEL SUPPLY SYSTEM OF INTERNAL COMBUSTION ENGINE

CROSS REFERENCE TO RELATED APPLICATION

This application is based on and incorporates herein by reference Japanese Patent Application No. 2004-93776 filed on Mar. 26, 2004.

BACKGROUND OF THE INVENTION

1. Field of the Invention

The present invention relates to a fuel supply system of an internal combustion engine improving a control method of a high-pressure pump.

2. Description of Related Art

A direct injection type engine, which injects fuel directly into cylinders, needs to promote atomization of the injected fuel by increasing an injection pressure in order to ensure combustibility. Therefore, in the direct injection type engine, a low-pressure pump draws the fuel from a fuel tank, and a high-pressure pump pressurizes the fuel to a high pressure and pressure-feeds the fuel to fuel injection valves. For instance, a high-pressure pump disclosed in JP-A-2001-304071 (pages 3, 4, etc.) drives a plunger, which reciprocates in a pump chamber for suctioning and discharging the fuel, with a camshaft of the engine. The high-pressure pump regulates a fuel discharge quantity (or a fuel pressure for supplying the fuel to the fuel injection valves) by opening and closing a suction passage of the pump chamber with an electromagnetic valve.

Generally, a phase of a cam (or a phase of the plunger) is recognized based on a crank angle sensed by a crank angle sensor during operation of the engine, and energization of the electromagnetic valve is controlled based on the crank angle. Thus, opening timing and closing timing of the electromagnetic valve with respect to the reciprocating movement of the plunger, which is driven by the camshaft of the engine, is controlled, and the fuel discharge quantity is controlled. Thus, the high-pressure pump is controlled. Therefore, the crank angle (the phase of the cam) cannot be sensed before crank angle determination, or cylinder determination, based on the output signal of the crank angle sensor and the like is completed during an engine starting period. Accordingly, the opening timing and the closing timing of the electromagnetic valve with respect to the reciprocating movement of the plunger cannot be controlled. Therefore, the suction passage of the high-pressure pump is held at the opened state by holding the electromagnetic valve at the opened state so that the fuel supplied by the low-pressure pump can be supplied to the fuel injection valve side before the completion of the crank angle determination during the engine starting period.

In the high-pressure pump, the electromagnetic valve opens and closes at each reciprocating movement of the plunger during the operation of the engine. Therefore, operation noise (collision noise) is generated by collision between a valve member and a valve seat or collision between a movable portion and a stopper portion accompanying the opening and closing of the electromagnetic valve. The operation noise is not audible to vehicle occupants because of engine sound or travel noises such as a road noise caused during the travel when the engine is in an operation state in which an engine rotation speed is high. The engine sound and the other noises decrease when the engine is in another operation state in which the engine rotation speed is low (for instance, an idling operation state). In such a case, there is a possibility that the operation sound of the electromagnetic valve is audible to the vehicle occupants, so the vehicle occupants suffer discomfort.

In the control of the high-pressure pump of the related art explained above, the electromagnetic valve is held at the opened state and the suction passage of the high-pressure pump is held at the opened state until the crank angle determination is completed during the engine starting period. Accordingly, the fuel supplied by the low-pressure pump is scarcely pressurized by the high-pressure pump and is supplied toward the fuel injection valves while the fuel remains low-pressure. Therefore, the injected fuel cannot be atomized sufficiently in an early stage of the engine starting period. As a result, the combustibility is deteriorated, and starting performance and exhaust emission are deteriorated.

SUMMARY OF THE INVENTION

It is therefore an object of the present invention to improve quietness by making operation sound of the high-pressure pump inaudible to a vehicle occupant.

It is another object of the present invention to improve starting performance and exhaust emission of an internal combustion engine by increasing a pressure of fuel from an early stage of an engine starting period with the use of a high-pressure pump.

According to an aspect of the present invention, a fuel supply system of an internal combustion engine includes a high-pressure pump, pump controlling means, a secondary suction passage, and a check valve. The high-pressure pump includes a pump chamber provided between a fuel suction passage and a fuel discharge passage, a plunger reciprocating in the pump chamber for suctioning and discharging fuel, and an electromagnetic valve for opening and closing the fuel suction passage. The pump controlling means controls a fuel discharge quantity of the high-pressure pump by controlling opening timing and closing timing of the electromagnetic valve with respect to the reciprocating movement of the plunger. The secondary suction passage branches from the fuel suction passage and communicates with the pump chamber. The check valve is disposed in the secondary suction passage. The pump controlling means performs valve closing control for holding the electromagnetic valve at a closed state when a rotation speed of the engine is equal to or lower than a predetermined value.

In the above structure, the valve closing control for holding the electromagnetic valve at the closed state is performed when the engine rotation speed becomes equal to or lower than the predetermined value (for instance, an idling rotation speed) and engine sound or travel noise reduces. Thus, operation sound (collision sound) of the electromagnetic valve is stopped. As a result, the operation sound of the electromagnetic valve can be made inaudible to vehicle occupants and quietness can be improved. During the valve closing control, the electromagnetic valve is held at the closed state and the fuel suction passage is closed. Since the secondary suction passage equipped with the check valve is provided, the check valve of the secondary suction passage opens and the fuel is suctioned from the secondary suction passage into the pump chamber when a fuel pressure in the pump chamber decreases in a suction stroke of the plunger, and the check valve of the secondary suction passage closes and the fuel is discharged to the fuel discharge passage when the fuel pressure in the pump chamber increases in a discharge stroke of the plunger. Therefore, the fuel supplied from a low-pressure pump can be pressurized and supplied to a fuel injection valve side by the high-pressure pump even if the electromagnetic valve is held at the closed state.

According to another aspect of the present invention, the fuel supply system performs the valve closing control of the electromagnetic valve when a crank angle of the engine cannot be sensed.

In the above structure, the valve closing control for holding the electromagnetic valve at the closed state is performed when the crank angle cannot be sensed before crank angle determination is completed during an engine starting period. Thus, the fuel supplied from the low-pressure pump can be pressurized and supplied to the fuel injection valve side by the high-pressure pump with the use of the check valve of the secondary suction passage even when the opening timing and the closing timing of the electromagnetic valve cannot be controlled. Thus, atomization of the injected fuel can be promoted and combustibility can be improved from an early stage of the engine starting period. As a result, engine starting performance and exhaust emission can be improved.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS

First Embodiment

Figure 1:
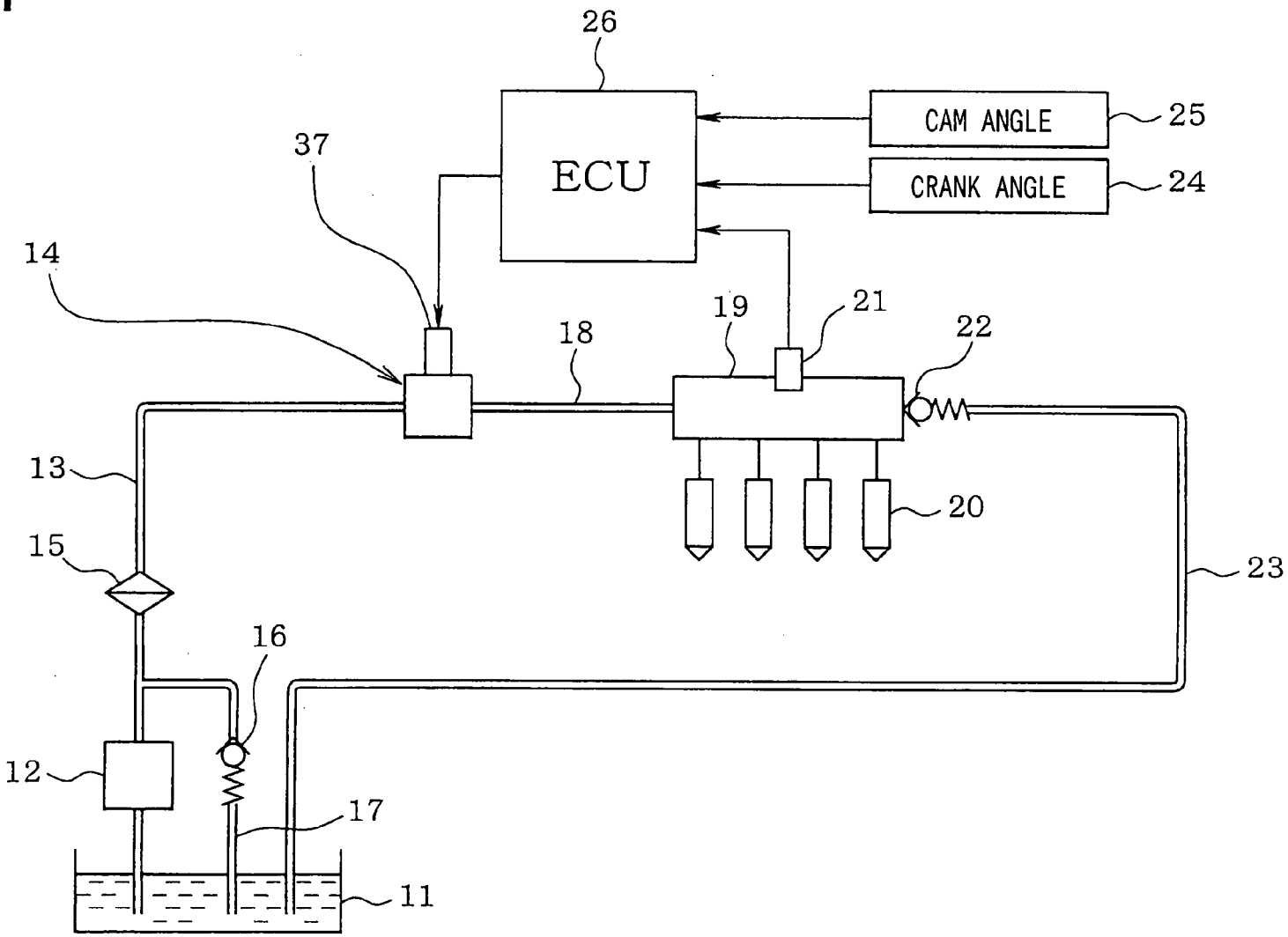
FIG. 1 is a schematic diagram showing a fuel supply system of an internal combustion engine according to a first embodiment of the present invention.

Referring to FIG. 1, a fuel supply system of a direct injection type gasoline engine (an internal combustion engine) according to a first embodiment of the present invention is illustrated. An electric low-pressure pump 12 for drawing fuel is disposed in a fuel tank 11 storing the fuel. The low-pressure pump 12 is driven by an electric motor using a battery as a power source. The fuel discharged from the low-pressure pump 12 is supplied to a mechanical high-pressure pump 14 through a low-pressure side fuel pipe 13. A fuel filter 15 is disposed in the low-pressure side fuel pipe 13. A low-pressure regulator 16 is connected to the low-pressure side fuel pipe 13. The low-pressure regulator 16 regulates a discharge pressure of the low-pressure pump 12 (a fuel supply pressure to the high-pressure pump 14) to a predetermined pressure. Excess fuel causing a pressure higher than the predetermined pressure is returned into the fuel tank 11 through a fuel return pipe 17.

The fuel discharged from the high-pressure pump 14 is pressure-fed to a delivery pipe 19 through a high-pressure side fuel pipe 18. Then, the high-pressure fuel is distributed to fuel injection valves 20 of respective cylinders from the delivery pipe 19. A pressure sensor 21 for sensing a fuel pressure is mounted to the delivery pipe 19. A high-pressure regulator 22 is connected to the delivery pipe 19. The high-pressure regulator 22 limits a maximum fuel pressure in the delivery pipe 19 below a predetermined pressure. Excess fuel causing a pressure higher than the predetermined pressure is returned into the fuel tank 11 through a fuel return pipe 23. The high-pressure regulator 22 is a mechanical regulator. A valve opening pressure of the high-pressure regulator 22 is fixed to a constant value by a spring and the like, and determines the maximum fuel pressure in the delivery pipe 19.

A crank angle sensor 24 outputs a crank angle signal each time a crankshaft of the engine rotates by a predetermined crank angle. A cam angle sensor 25 outputs a cam angle signal each time a camshaft 32 of the engine shown in FIG. 2 rotates by a predetermined cam angle.

Outputs of the above sensors are inputted to an engine control unit (ECU) 26. The ECU 26 is structured mainly by a microcomputer. The ECU 26 executes various types of engine control programs stored in ROM (a storage medium), which is included in the ECU 26. Thus, the ECU 26 controls a fuel injection quantity of the fuel injection valves 20 and ignition timing of ignition plugs in accordance with an engine operation state.

Figure 2:
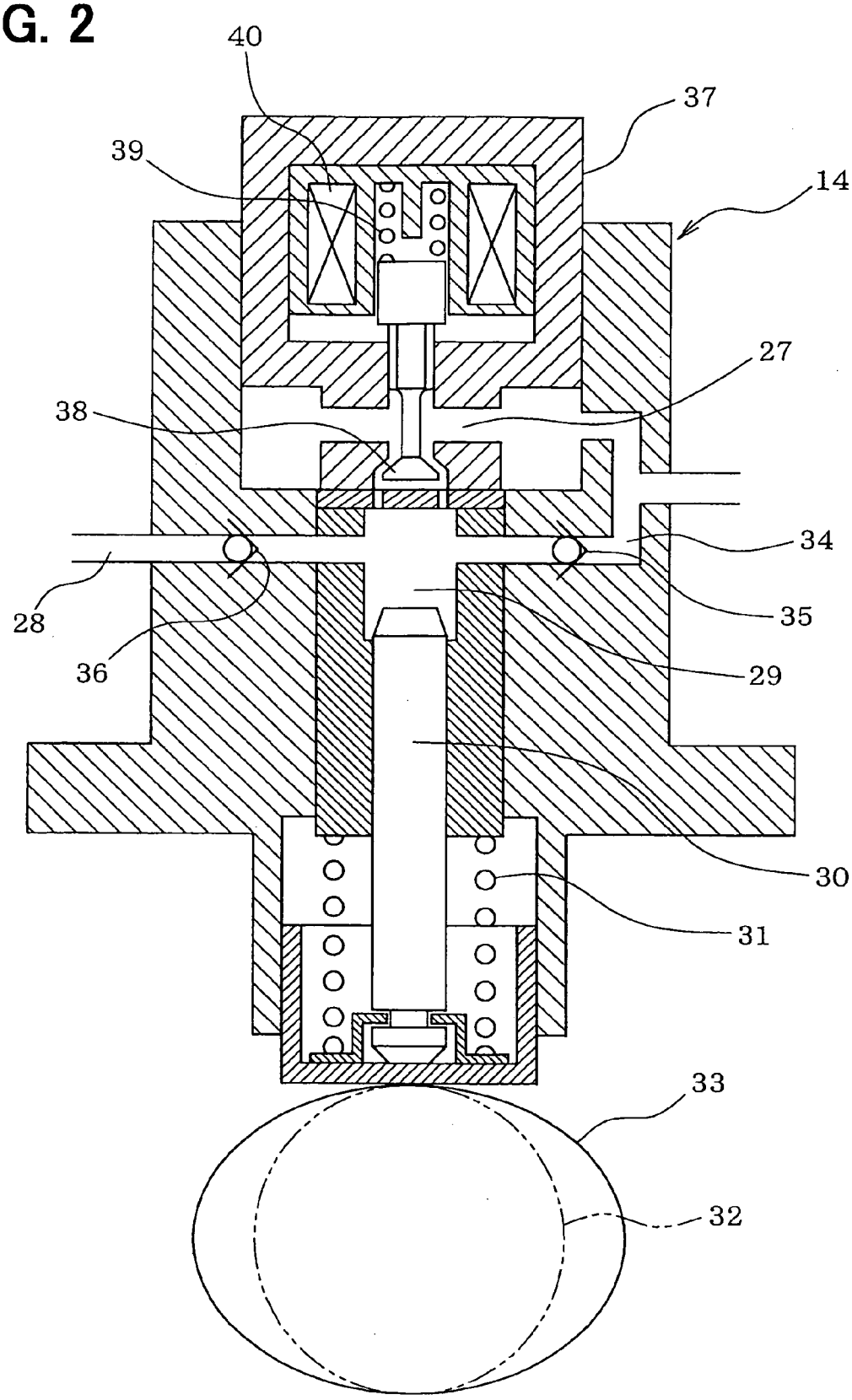
FIG. 2 is a sectional view showing a high-pressure pump of the fuel supply system according to the first embodiment.

The high-pressure pump 14 is a plunger pump. More specifically, as shown in FIG. 2, the high-pressure pump 14 has a cylindrical pump chamber 29 between a fuel suction passage 27 and a fuel discharge passage 28. The high-pressure pump 14 suctions and discharges the fuel by reciprocating a plunger 30 in the pump chamber 29. The plunger 30 is biased by a spring 31 in a suctioning direction (downward, in FIG. 2) and is driven by rotating movement of a pump cam 33, which is mounted to the camshaft 32 of the engine so that the pump cam 33 can rotate with the camshaft 32 in an integrated manner. Thus, a lifting distance of the plunger 30, or a pump cam lift Lp, changes cyclically in accordance with the crank angle CA as shown in FIGS. 4 and 5.

As shown in FIG. 2, the high-pressure pump 14 is formed with a secondary suction passage 34, which branches from the suction passage 27 and communicates with the pump chamber 29. Check valves 35, 36 for preventing a backflow of the fuel are disposed in the secondary suction passage 34 and the discharge passage 28 respectively. An electromagnetic valve 37 for controlling the fuel discharge quantity is disposed in the suction passage 27. The electromagnetic valve 37 is a normally open type electromagnetic valve. The electromagnetic valve 37 has a valve member 38, a spring 39 and a solenoid 40. The valve member 38 opens and closes the suction passage 27. The spring 39 biases the valve member 38 in a valve opening direction. The solenoid 40 drives the valve member 38 in a valve closing direction by a electromagnetic force. The valve member 38 is opened by the biasing force of the spring 39 and the suction passage 27 is opened when driving current is not supplied to the solenoid 40. The electromagnetic force of the solenoid 40 closes the valve member 38 against the biasing force of the spring 39 and the suction passage 27 is closed if the driving current is supplied to the solenoid 40.

Figure 4:
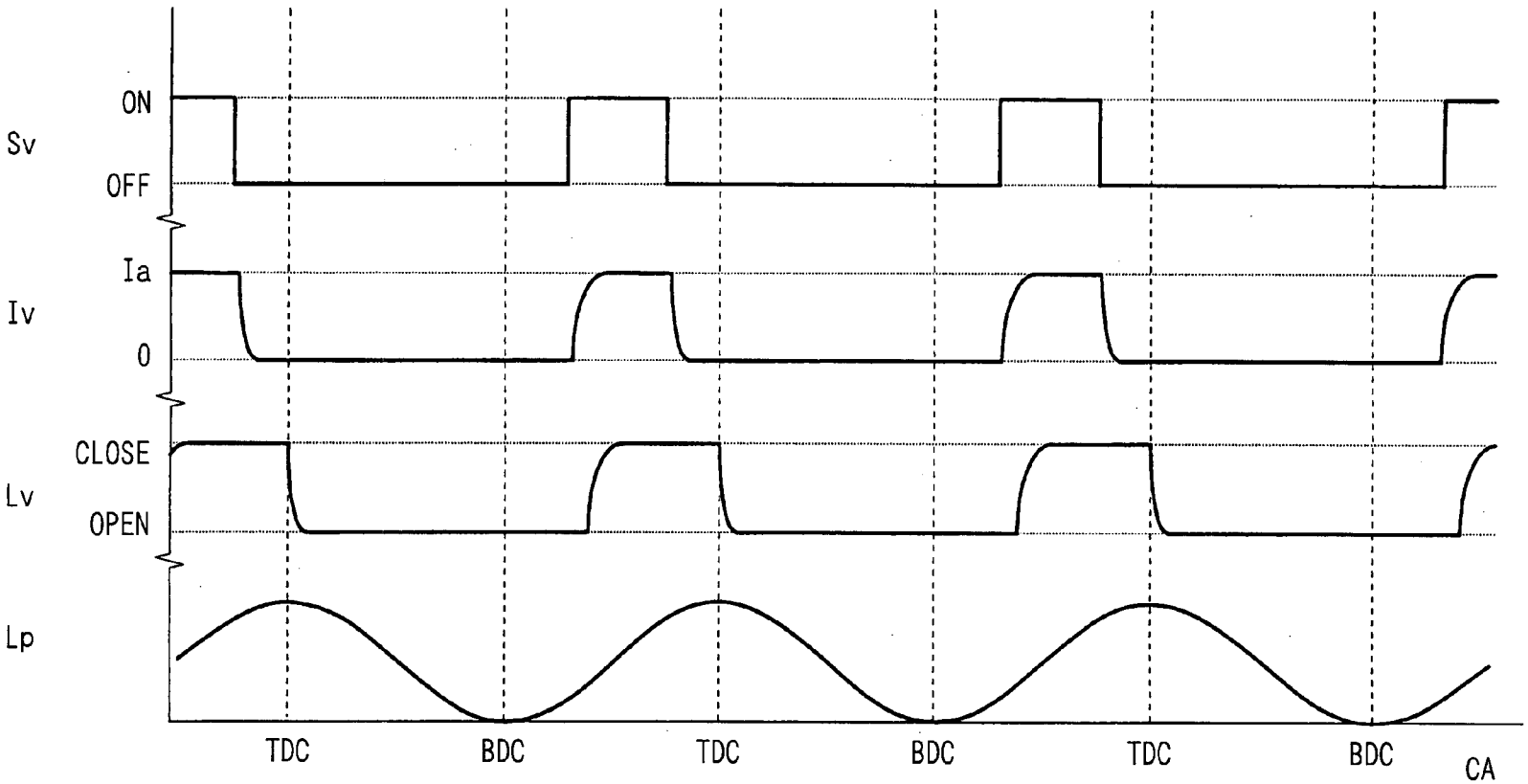
FIG. 4 is a time chart showing normal control of an electromagnetic valve of the high-pressure pump according to the first embodiment.
Figure 5:
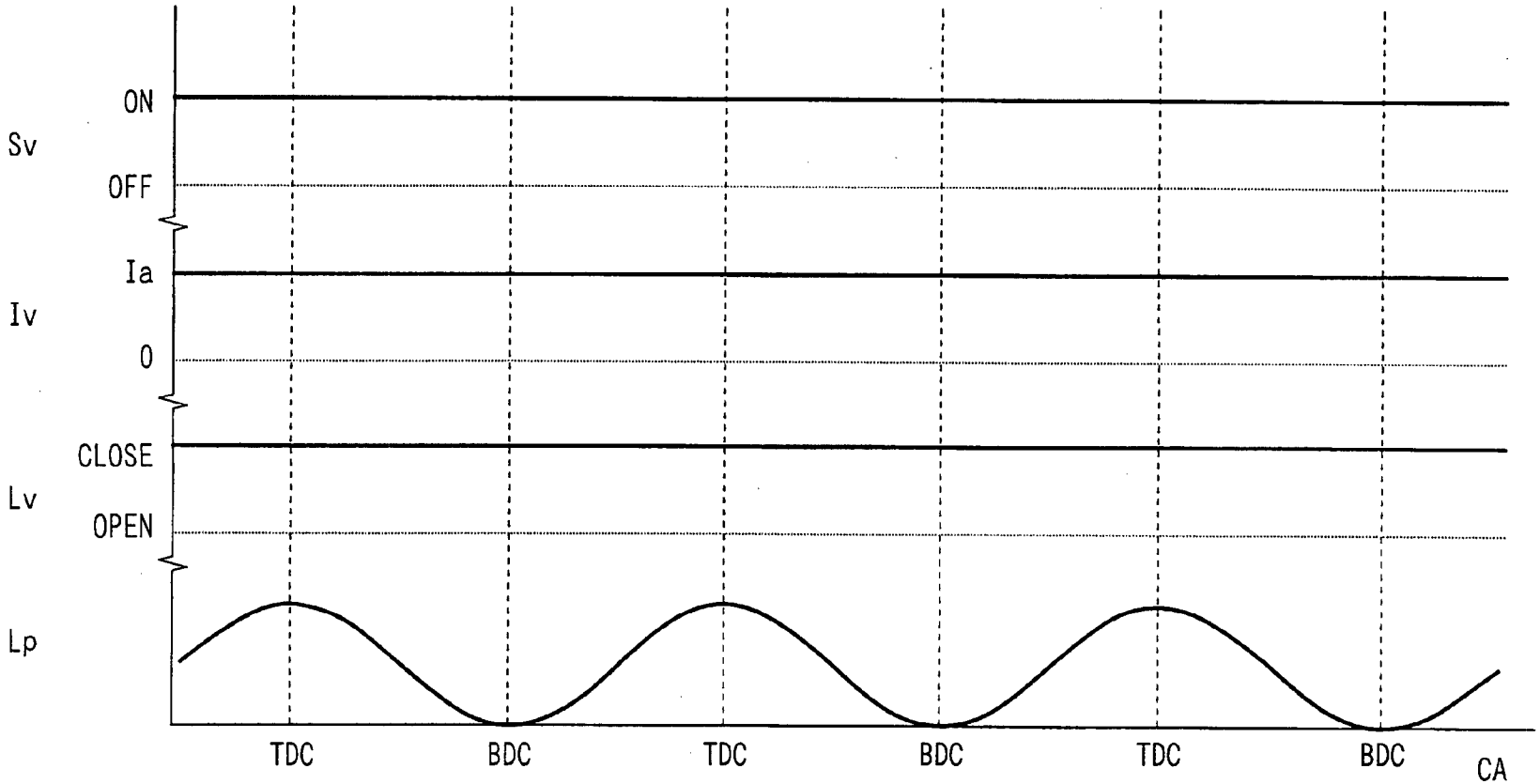
FIG. 5 is a time chart showing valve closing control of the electromagnetic valve of the high-pressure pump according to the first embodiment.

As shown in FIG. 4, the electromagnetic valve 37 is opened and the fuel is suctioned into the pump chamber 29 in a suction stroke of the high-pressure pump 14 (a stroke in which the plunger 30 moves from a top dead center TDC to a bottom dead center BDC). In FIG. 4, a sign Sv denotes a driving signal of the electromagnetic valve 37, Iv is the driving current of the electromagnetic valve 37, and Lv is a valve-lifting distance of the electromagnetic valve 37. Start timing for closing the electromagnetic valve 37 is controlled in a discharge stroke (a stroke in which the plunger 30 moves from the bottom dead center BDC to the top dead center TDC). Thus, the fuel discharge quantity is controlled and the fuel pressure in the delivery pipe 19 (a high-pressure side fuel pressure) is controlled. For instance, the start timing for closing the electromagnetic valve 37 is advanced when the high-pressure side fuel pressure is increased. Thus, a valve closing period (an effective stroke) until the end of the discharge stroke is lengthened to increase the fuel discharge quantity. To the contrary, the start timing for closing the electromagnetic valve 37 is delayed when the high-pressure side fuel pressure is decreased. Thus, the valve closing period (the effective stroke) until the end of the discharge stroke is shortened to decrease the fuel discharge quantity.

The ECU 26 performs crank angle determination (namely, cylinder determination) based on the output signal of the crank angle sensor 24 (or the output signals of the crank angle sensor 24 and the cam angle sensor 25) during an engine starting period so that the ECU 26 can sense the crank angle CA based on the output signal of the crank angle sensor 24. A phase of the pump cam 33 (or a phase of the plunger 30) can be recognized based on the crank angle CA sensed by the crank angle sensor 24 after the crank angle determination is completed. In a system in which the phase of the camshaft 32 (the camshaft phase) with respect to the crank shaft is varied, the phase of the pump cam 33 (or the phase of the plunger 30) can be recognized based on the crank angle CA by sensing the camshaft phase based on the output signals of the crank angle sensor 24 and the cam angle sensor 25.

Figure 3:
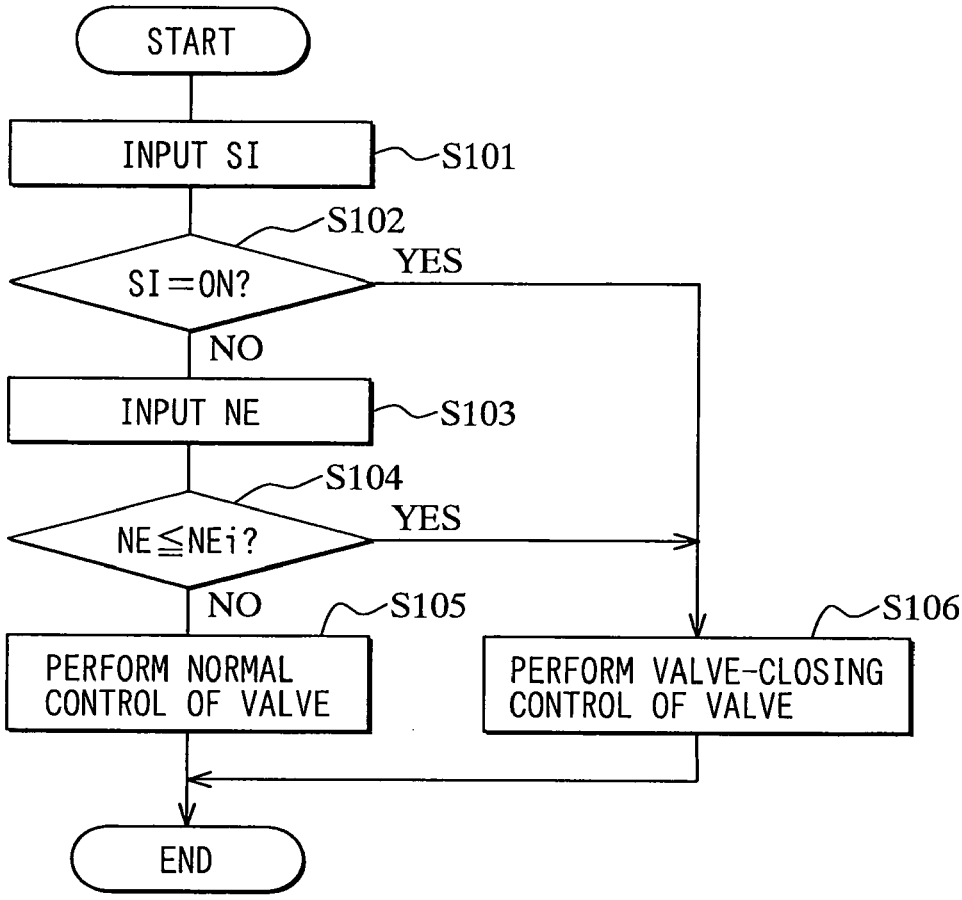
FIG. 3 is a flowchart showing processing steps of a high-pressure pump control program according to the first embodiment.

The ECU 26 executes a high-pressure pump control program shown by a flowchart of FIG. 3 during the operation of the engine. Thus, the ECU 26 performs normal control for opening and closing the electromagnetic valve 37 when the engine rotation speed is higher than a predetermined value (for instance, an idling rotation speed). The ECU 26 performs valve closing control for holding the electromagnetic valve 37 at the closed state when the engine rotation speed is equal to or lower than the predetermined value (or when the engine rotation speed is in a low rotation speed range).

During the normal control, the ECU 26 controls turning on and off of the energization of the electromagnetic valve 37 based on the crank angle CA (the phase of the pump cam 33) as shown in FIG. 4. Thus, the ECU 26 controls the opening timing and the closing timing of the electromagnetic valve 37 with respect to the reciprocating movement of the plunger 30 in order to control the fuel discharge quantity (the high-pressure side fuel pressure).

During the valve closing control, the driving current Iv at a current value Ia, which is equal to the current value Ia of the driving current Iv in the normal control, is continuously supplied to the electromagnetic valve 37 as shown in FIG. 5. Thus, the electromagnetic valve 37 is held at the closed state. Thus, operation sound (collision sound) of the electromagnetic valve 37 is stopped when the engine rotation speed becomes equal to or lower than a predetermined value (for instance, the idling rotation speed or a speed slightly higher than the idling rotation speed) and engine sound or travel noise such as a road noise reduces.

During the valve closing control, the high-pressure pump 14 is brought to a state in which the electromagnetic valve 37 is held at the closed state and the suction passage 27 is closed. Since the secondary suction passage 34 equipped with the check valve 35 is provided, the check valve 35 opens and the fuel is suctioned through the secondary suction passage 34 when the fuel pressure in the pump chamber 29 decreases in the suction stroke of the plunger 30, and the check valve 35 closes and the fuel is discharged to the discharge passage 28 when the fuel pressure in the pump chamber 29 increases in the discharge stroke of the plunger 30. Thus, the fuel supplied from the low-pressure pump 12 can be pressurized and supplied to the delivery pipe 19 by the high-pressure pump 14 even if the electromagnetic valve 37 is held at the closed state. The fuel discharge quantity of the high-pressure pump 14 cannot be controlled during the valve closing control. However, the high-pressure regulator 22 regulates the fuel pressure in the delivery pipe 19 (the pressure of the fuel supplied to the fuel injection valves 20) to the predetermined pressure.

Next, processing steps of the high-pressure pump control program executed by the ECU 26 will be explained based on FIG. 3.

The high-pressure pump control program shown in FIG. 3 is executed in a predetermined cycle during the operation of the engine. If the program is started, an idling switch signal SI is inputted in Step S101, first. Then, it is determined whether an idling switch is ON (whether the engine is in idling operation) in Step S102.

If the result of the determination in Step S102 is "NO", the ECU 26 proceeds to Step S103. In Step S103, the engine rotation speed NE sensed by the crank angle sensor 24 is inputted. Then, in Step S104, it is determined whether the engine rotation speed NE is "equal to or lower than" a predetermined value NEi (for instance, the idling rotation speed or a speed slightly higher than the idling rotation speed).

If the result of the determination in Step S104 is "NO", the ECU 26 proceeds to Step S105. In Step S105, the normal control of the electromagnetic valve 37 is performed. In the normal control, the turning on and off of the energization of the electromagnetic valve 37 is controlled based on the crank angle CA (the phase of the pump cam 33) as shown in FIG. 4. Thus, the opening timing and the closing timing of the electromagnetic valve 37 with respect to the reciprocating movement of the plunger 30 is controlled and the fuel discharge quantity (or the high-pressure side fuel pressure) is controlled.

If the result of the determination in Step S102 is "YES" or if the result of the determination in Step S104 is "YES", it is determined that the engine is in the idling operation state. Therefore, it is determined that the engine sound or the travel noise decreases. In this case, the ECU 26 proceeds to Step S106. In Step S106, the valve closing control of the electromagnetic valve 37 is performed. During the valve closing control, as shown in FIG. 5, the driving current Iv at the current value Ia, which is equal to the current value Ia of the driving current Iv in the normal control, is continuously supplied to the electromagnetic valve 37 to hold the electromagnetic valve 37 at the closed state.

In the present embodiment, the valve closing control for holding the electromagnetic valve 37 of the high-pressure pump 14 at the closed state is performed when the engine rotation speed becomes equal to or lower than the predetermined value (the idling rotation speed or the speed slightly higher than the idling rotation speed) and the engine sound or the travel noise decreases. Thus, the operation sound (the collision sound) of the electromagnetic valve 37 can be stopped. Therefore, the operation sound of the electromagnetic valve 37 can be made inaudible to the vehicle occupants, and the quietness can be improved. During the valve closing control, the electromagnetic valve 37 is held at the closed state and the suction passage 27 is closed. However, since the secondary suction passage 34 equipped with the check valve 35 is provided, the fuel supplied from the low-pressure pump 12 can be pressurized and supplied to the delivery pipe 19 by the reciprocating movement of the plunger 30 of the high-pressure pump 14.

Second Embodiment

Next, a fuel supply system according to a second embodiment of the present invention will be explained based on FIG. 6.

As explained above, the high-pressure pump 14 suctions the fuel through the secondary suction passage 34 during the valve closing control of the electromagnetic valve 37. However, the fuel injection quantity of the engine decreases when the engine is in a low rotation speed operation state (for instance, the idling operation state), in which the valve closing control is performed.

Figure 6:
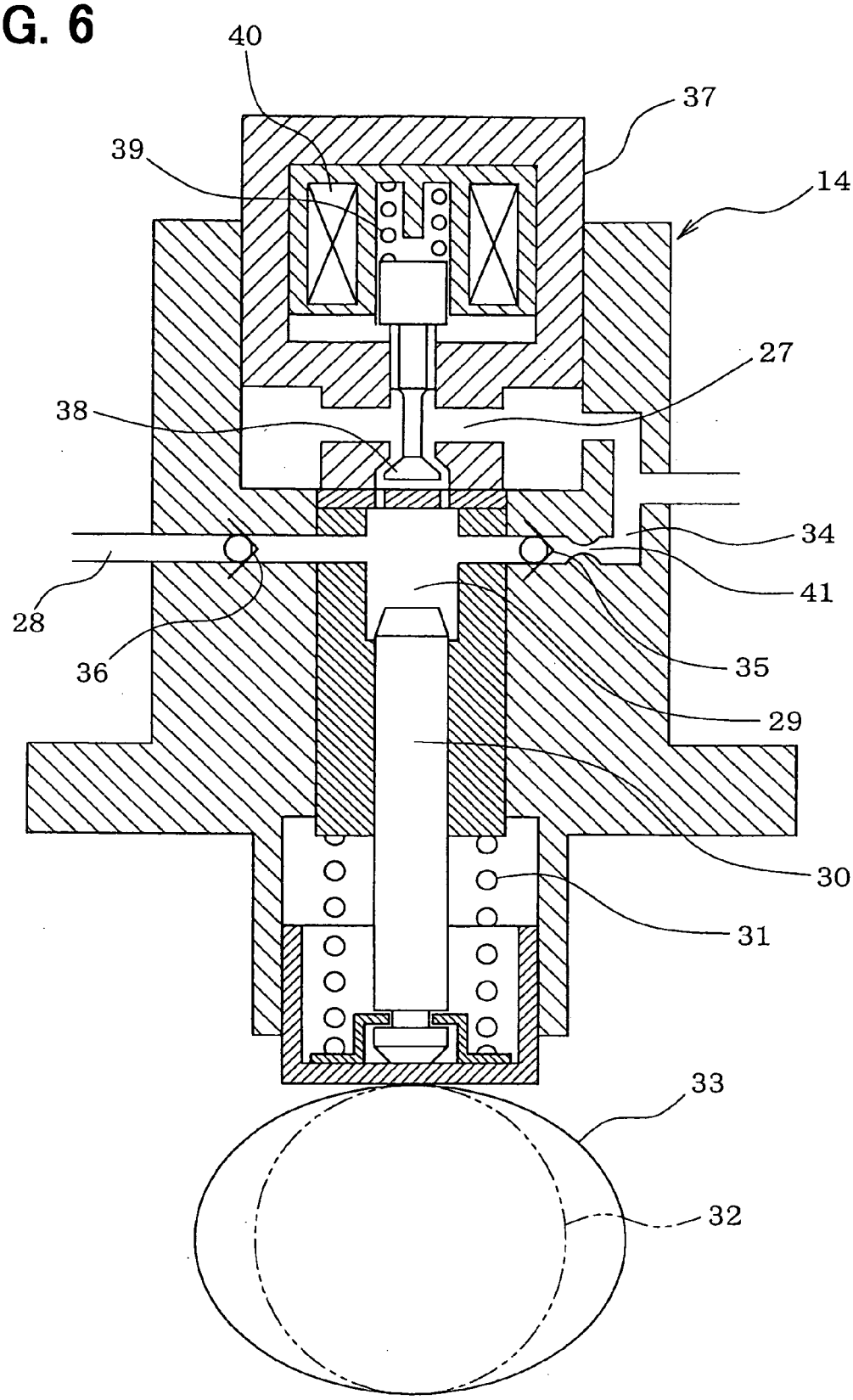
FIG. 6 is a sectional view showing a high-pressure pump of a fuel supply system according to a second embodiment of the present invention.

Therefore, in the second embodiment, a restriction passage portion 41, of which a passage sectional area is narrowed, is formed in the secondary suction passage 34 of the high-pressure pump 14 on an upstream side or a downstream side of the check valve 35 as shown in FIG. 6. The passage sectional area of the restriction passage portion 41 is larger than an area capable of suctioning the fuel quantity corresponding to the fuel injection quantity in the idling operation period and is smaller than an area capable of suctioning a fuel quantity corresponding to a volume of a space in which the plunger 30 descends in the idling operation period. The other structure is the same as the first embodiment.

In the second embodiment, the restriction passage portion 41 is formed in the secondary suction passage 34. Therefore, the fuel suctioned through the secondary suction passage 34 is suitably restricted by the restriction passage portion 41 during the valve closing control (or during the low rotation speed operation of the engine), in which the fuel injection quantity of the engine decreases. Thus, excessive fuel supply to the delivery pipe 19 can be prevented, and the quantity of the excess fuel returned from the delivery pipe 19 to the fuel tank 11 can be reduced. Thus, energy consumption of the high-pressure pump 14 can be reduced.

Third Embodiment

Next, a fuel supply system according to a third embodiment of the present invention will be explained based on FIG. 7.

As explained above, the ECU 26 recognizes the phase of the pump cam 33 (the phase of the plunger 30) based on the crank angle sensed by the crank angle sensor 24 and controls the energization of the electromagnetic valve 37 based on the crank angle. Thus, the ECU 26 controls the opening timing and the closing timing of the electromagnetic valve 37 with respect to the reciprocating movement of the plunger 30. Therefore, the crank angle (the phase of the pump cam 33) cannot be sensed before the crank angle determination (the cylinder determination) based on the output signal of the crank angle sensor 24 and the like is completed during the engine starting period. At that time, the ECU 26 cannot control the opening timing and the closing timing of the electromagnetic valve 37 with respect to the reciprocating movement of the plunger 30.

Figure 7:
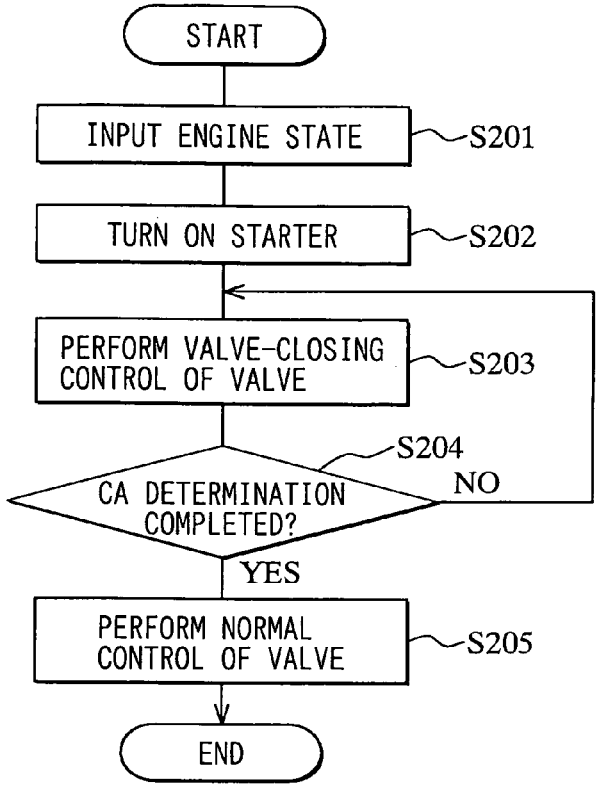
FIG. 7 is a flowchart showing processing steps of a starting period high-pressure pump control program according to a third embodiment of the present invention.

Therefore, in the present embodiment, the ECU 26 executes a starting period high-pressure pump control program shown by a flowchart of FIG. 7. Thus, the ECU 26 performs the valve closing control for holding the electromagnetic valve 37 at the closed state when the crank angle cannot be sensed before the completion of the crank angle determination during the engine starting period. The ECU 26 starts the normal control for opening and closing the electromagnetic valve 37 when the crank angle determination is completed so that the crank angle can be sensed.

The starting period high-pressure pump control program shown in FIG. 7 is executed after the ignition switch is turned on. If the program shown in FIG. 7 is started, the engine state is inputted in Step S201, first. Then, in Step S202, a starter is turned on to start the engine. Then, in Step S203, the valve closing control for holding the electromagnetic valve 37 at the closed state is started.

Then, in Step S204, it is determined whether the crank angle determination (the cylinder determination) based on the output signal of the crank angle sensor 24 (or the output signals of the crank angle sensor 24 and the cam angle sensor 25) is completed. If the result of the determination in Step S204 is "NO", it is determined that the crank angle CA (the phase of the pump cam 33) cannot be sensed yet, and the valve closing control of the electromagnetic valve 37 is continued.

Then, it is determined that the crank angle CA (the phase of the pump cam 33) can be sensed at the time when it is determined that the crank angle determination is completed in Step S204. Then, in Step S205, the normal control for opening and closing the electromagnetic valve 37 is started.

In the present embodiment, the valve closing control for holding the electromagnetic valve 37 at the closed state is performed in the period in which the crank angle CA cannot be sensed before the completion of the crank angle determination during the engine starting period. Therefore, the fuel supplied from the low-pressure pump 12 can be pressurized and supplied to the delivery pipe 19 by the high-pressure pump 14 with the use of the check valve 35 of the secondary suction passage 34. Thus, the atomization of the injected fuel can be promoted and the combustibility can be improved from the early stage of the engine start. As a result, the starting performance and the exhaust emission can be improved.

The third embodiment may be used in combination with the first embodiment or the second embodiment.

Fourth Embodiment

Next, a fuel supply system according to a fourth embodiment of the present invention will be explained based on FIG. 8.

Generally, in order to improve opening response and closing response of the electromagnetic valve 37, the driving current Iv of the electromagnetic valve 37 in the normal control is set at the current value Ia higher than a value necessary for simply holding the electromagnetic valve 37 at the closed state. Electric consumption of the electromagnetic valve 37 during the valve closing control will increase if the driving current Iv at the current value Ia, which is the same as the current value Ia in the normal control, is continuously supplied to the electromagnetic valve 37 to hold the electromagnetic valve 37 at the closed state during the valve closing control. In such a case, there is a possibility that a heat generation amount of the electromagnetic valve 37 increases and the durability of the electromagnetic valve 37 is negatively affected.

Figure 8:
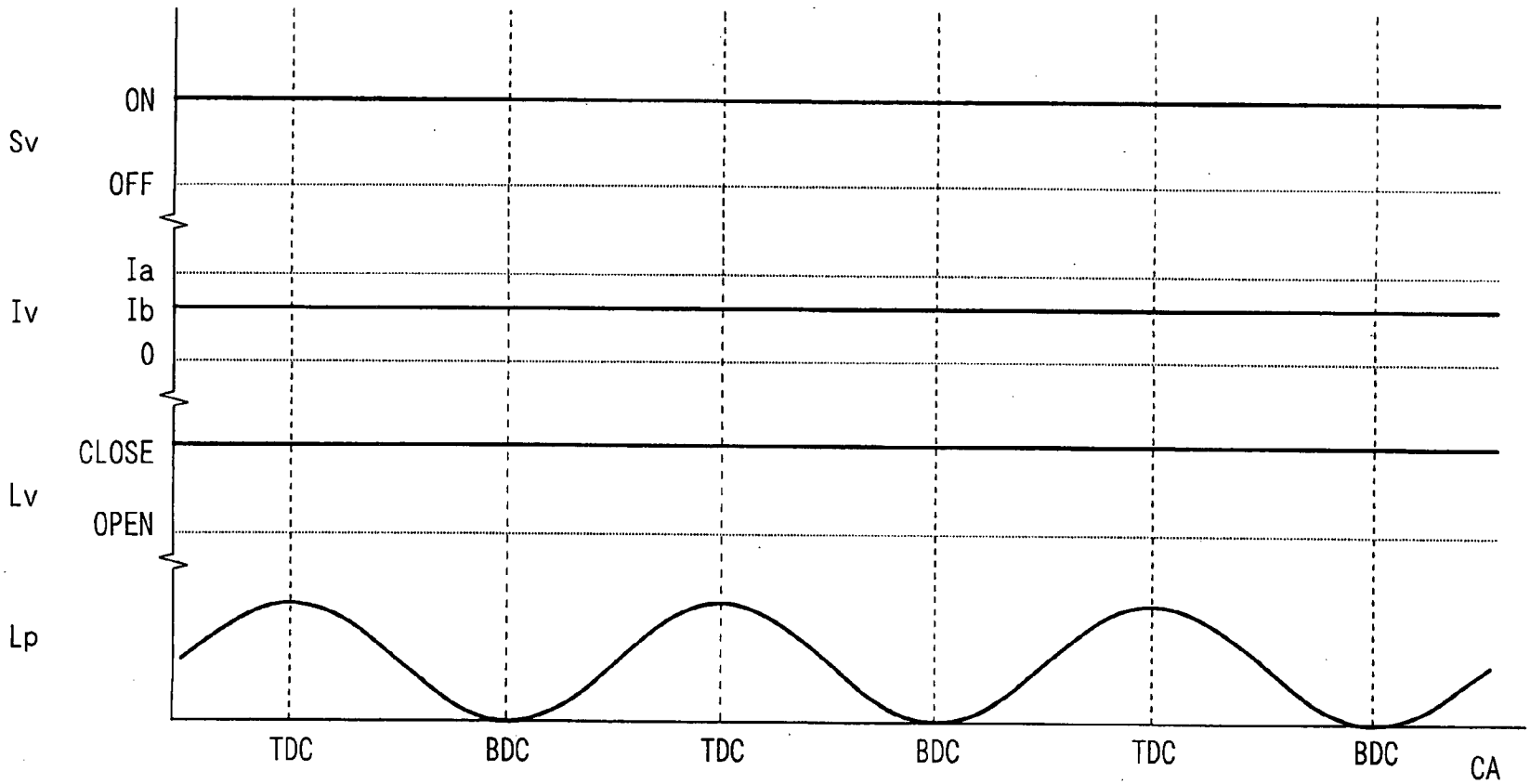
FIG. 8 is a time chart showing valve closing control of an electromagnetic valve of a high-pressure pump of a fuel supply system according to a fourth embodiment of the present invention.

Therefore, in the present embodiment, a driving current Iv at a current value Ib lower than the current value Ia in the normal control is continuously supplied to the electromagnetic valve 37 to hold the electromagnetic valve 37 at the closed state during the valve closing control as shown in FIG. 8. Thus, the electric consumption of the electromagnetic valve 37 during the valve closing control can be reduced. Meanwhile, the heat generation amount of the electromagnetic valve 37 can be reduced, and the durability of the electromagnetic valve 37 can be improved.

Fifth Embodiment

Figure 10:
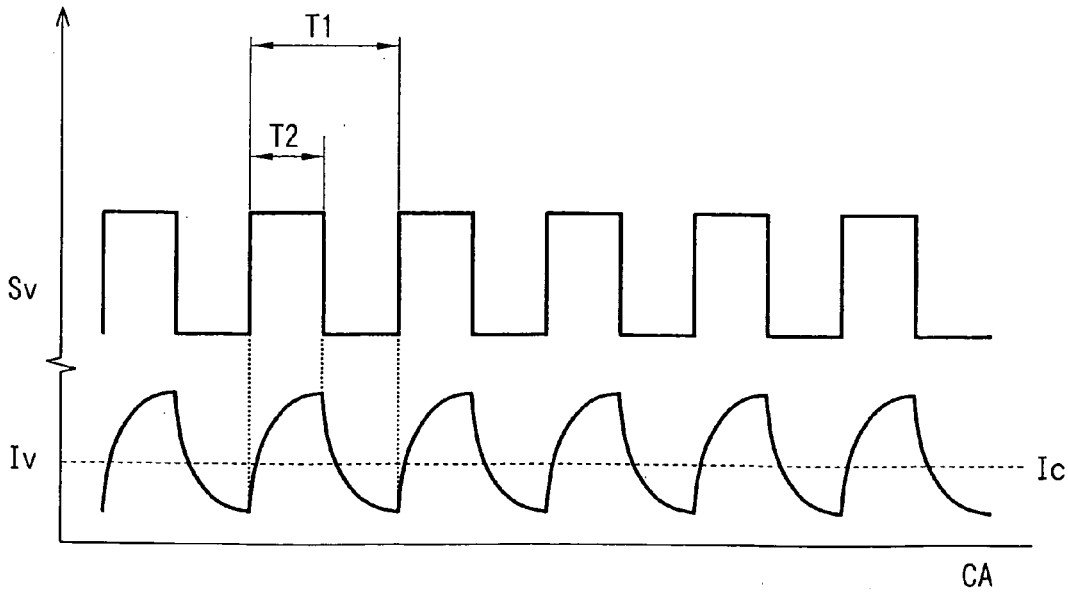
FIG. 10 is another time chart showing the valve closing control of the electromagnetic valve of the high-pressure pump according to the fifth embodiment.
Figure 9:
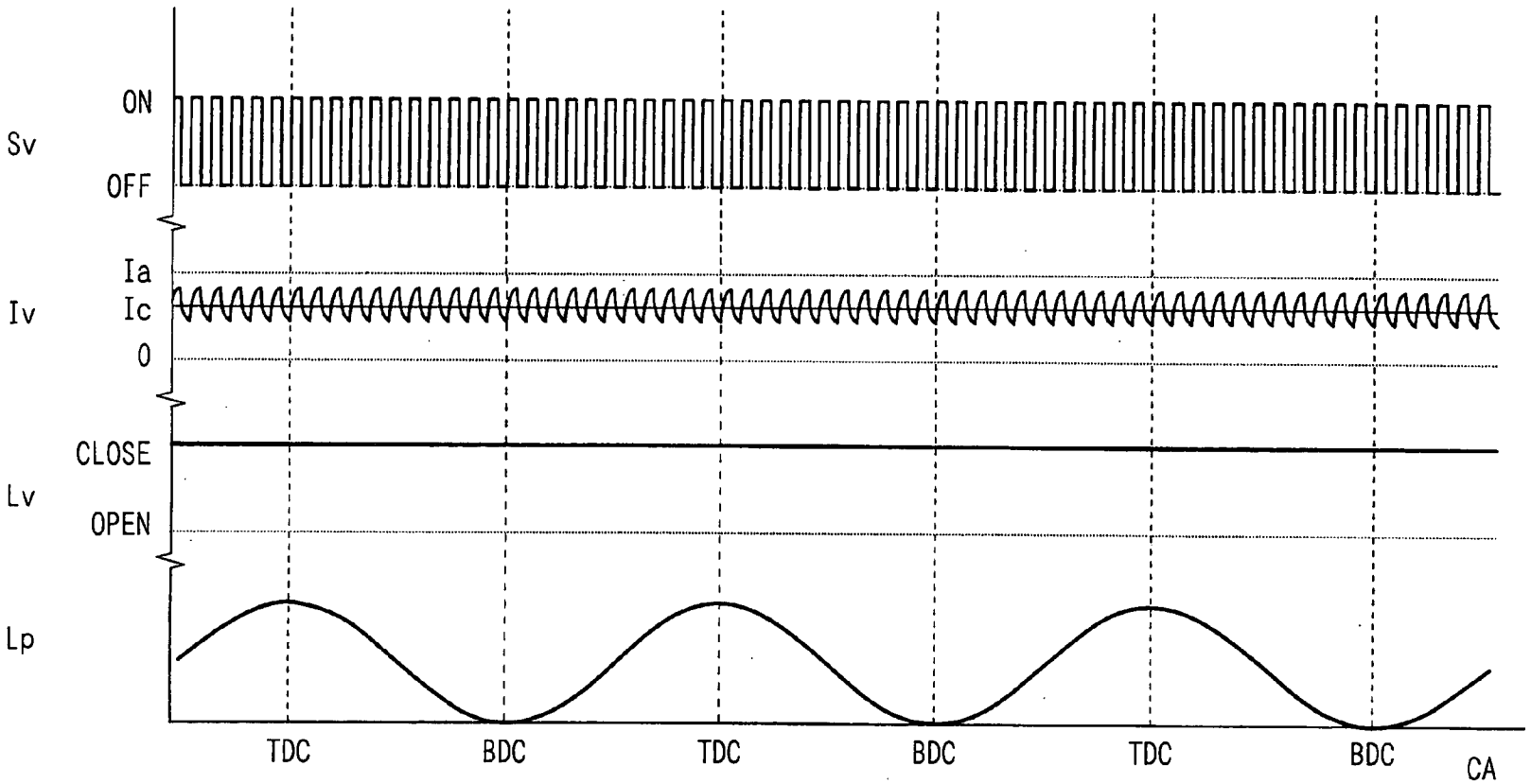
FIG. 9 is a time chart showing valve closing control of an electromagnetic valve of a high-pressure pump of a fuel supply system according to a fifth embodiment of the present invention.

Next, a fuel supply system according to a fifth embodiment of the present invention will be explained based on FIGS. 9 and 10.

The fuel supply system of the fifth embodiment holds the electromagnetic valve 37 at the closed state by performing duty cycle control of the driving current Iv of the electromagnetic valve 37 for setting an average value Ic of the driving current Iv during the valve closing control to a value lower than the driving current value Ia in the normal control. In this case, the average value Ic of the driving current Iv can be regulated by regulating a frequency (1/T1) or an ON time T2 of the driving current Iv shown in FIG. 10.

Also the fuel supply system of the fifth embodiment can reduce the electric consumption of the electromagnetic valve 37 during the valve closing control and can improve the durability of the electromagnetic valve 37 by reducing the heat generation amount of the electromagnetic valve 37.

Sixth Embodiment

Next, a fuel supply system according to a sixth embodiment of the present invention will be explained based on FIGS. 11 and 12.

Figure 11:
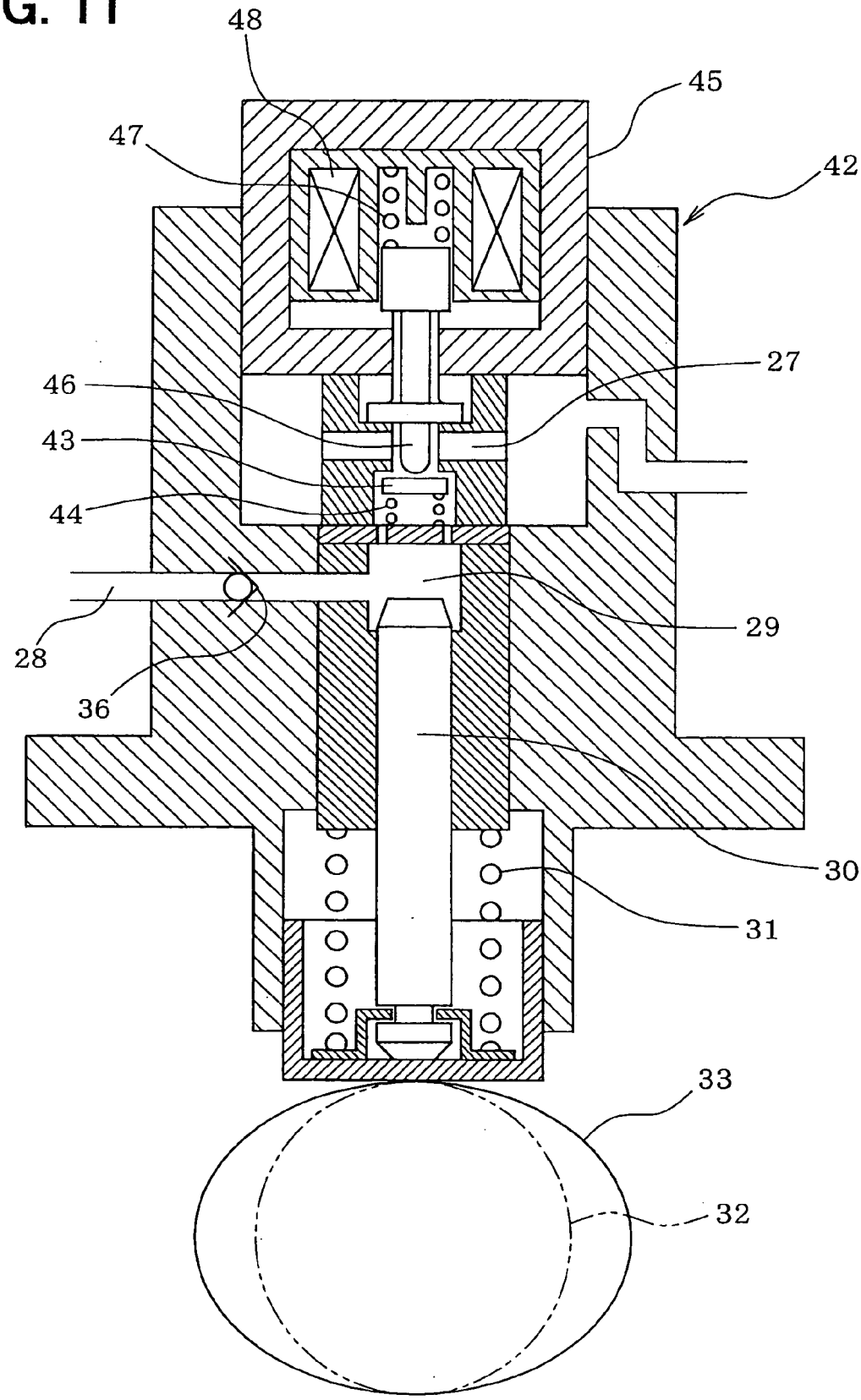
FIG. 11 is a sectional view showing a high-pressure pump of a fuel supply system according to a sixth embodiment of the present invention.

As shown in FIG. 11, a high-pressure pump 42 of the sixth embodiment has a check valve 43 in the suction passage 27. The check valve 43 is biased by a spring 44 in a valve closing direction. An electromagnetic actuator 45 for controlling the fuel discharge quantity is disposed above the check valve 43 in FIG. 11. The electromagnetic actuator 45 includes a plunger 46, a spring 47, and a solenoid 48. The plunger 46 opens the check valve 43. The spring 47 biases the plunger 46 in a valve opening direction of the check valve 43. The solenoid 48 drives the plunger 46 in a direction for eliminating the opening action of the check valve 43 by an electromagnetic force.

The biasing force of the spring 47 moves the plunger 46 to a valve opening position for compulsorily opening the check valve 43 when a driving current is not supplied to the solenoid 48. Thus, the suction passage 27 is opened. The electromagnetic driving force of the solenoid 48 moves the plunger 46 to a compulsory valve opening action elimination position for eliminating the compulsory opening action of the check valve 43 against the biasing force of the spring 47 if the driving current is supplied to the solenoid 48.

Figure 12:
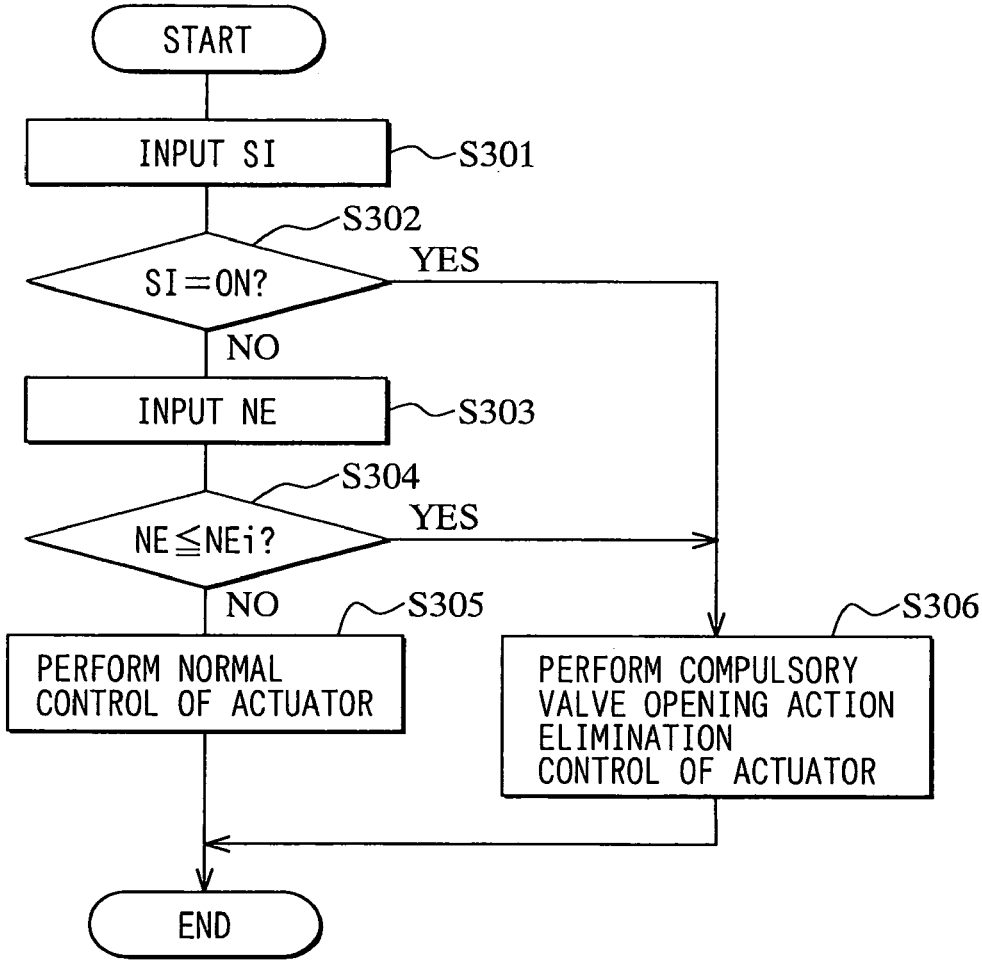
FIG. 12 is a flowchart showing processing steps of a high-pressure pump control program according to a sixth embodiment of the present invention.

The ECU 26 executes a high-pressure pump control program shown in FIG. 12 during the operation of the engine. Thus, the ECU 26 performs normal control for switching the electromagnetic actuator 45 between the compulsory valve opening position and the compulsory valve opening action elimination position when the engine rotation speed is higher than a predetermined value (for instance, the idling rotation speed or a rotation speed slightly higher than the idling rotation speed). The ECU 26 performs compulsory valve opening action elimination control for holding the electromagnetic actuator 45 at the compulsory valve opening action elimination position when the engine rotation speed is equal to or lower than the predetermined rotation speed.

During the normal control, the ECU 26 controls turning on and off of energization of the electromagnetic actuator 45 based on the crank angle CA (the phase of the pump cam 33). Thus, the ECU 26 controls opening timing and closing timing of the check valve 43 with respect to the reciprocating movement of the plunger 30 in order to control the fuel discharge quantity (or the high-pressure side fuel pressure).

During the compulsory valve opening action elimination control, the driving current Iv at the current value Ia, which is equal to the current value Ia of the driving current Iv in the normal control, is continuously supplied to the electromagnetic actuator 45 to hold the electromagnetic actuator 45 at the compulsory valve opening action elimination position. Thus, operation sound of the electromagnetic actuator 45 is stopped when the engine rotation speed becomes equal to or lower than the predetermined value (for instance, the idling rotation speed or the speed slightly higher than the idling rotation speed) and the engine sound or the travel noise decreases.

During the compulsory valve opening action elimination control, the electromagnetic actuator 45 is held at the compulsory valve opening action elimination position for eliminating the compulsory valve opening action of the check valve 43. Accordingly, the check valve 43 of the suction passage 27 opens and the fuel is suctioned from the suction passage 27 when the fuel pressure in the pump chamber 29 decreases in the suction stroke of the plunger 30. The check valve 43 of the suction passage 27 closes and the fuel is discharged to the discharge passage 28 when the fuel pressure in the pump chamber 29 increases in the discharge stroke of the plunger 30. Thus, the fuel supplied from the low-pressure pump 12 can be pressurized and supplied to the delivery pipe 19 by the high-pressure pump 42 even if the electromagnetic actuator 45 is held at the compulsory valve opening action elimination position.

Next, processing steps of the high-pressure pump control program performed by the ECU 26 of the sixth embodiment will be explained based on FIG. 12. If the program of FIG. 12 is started, the idling switch signal SI is inputted in Step S301, and then, it is determined whether the idling switch is ON in Step S302.

If the result of the determination in Step S302 is "NO", the engine rotation speed NE is inputted in Step S303, and it is determined whether the engine rotation speed NE is "equal to or lower than" a predetermined value NEi (the idling rotation speed or a speed slightly higher than the idling rotation speed) in Step S304.

If the result of the determination in Step S304 is "NO", the normal control of the electromagnetic actuator 45 is performed in Step S305.

If the result of the determination in Step S302 is "YES" or if the result of the determination in Step S304 is "YES", the compulsory valve opening action elimination control for holding the electromagnetic actuator 45 at the compulsory valve opening action elimination position is performed in Step S306.

The fuel supply system of the sixth embodiment performs the compulsory opening action elimination control for holding the electromagnetic actuator 45 at the compulsory opening action elimination position when the engine rotation speed NE becomes equal to or lower than the predetermined value NEi (the idling rotation speed or the speed slightly higher than the idling rotation speed) and the engine sound or the travel noise decreases. Thus, the operation sound of the electromagnetic actuator 45 is stopped. As a result, the operation sound of the electromagnetic actuator 45 can be made inaudible to the vehicle occupants and the quietness can be improved.

Seventh Embodiment

Next, a fuel supply system according to a seventh embodiment of the present invention will be explained based on FIG. 13.

Figure 13:
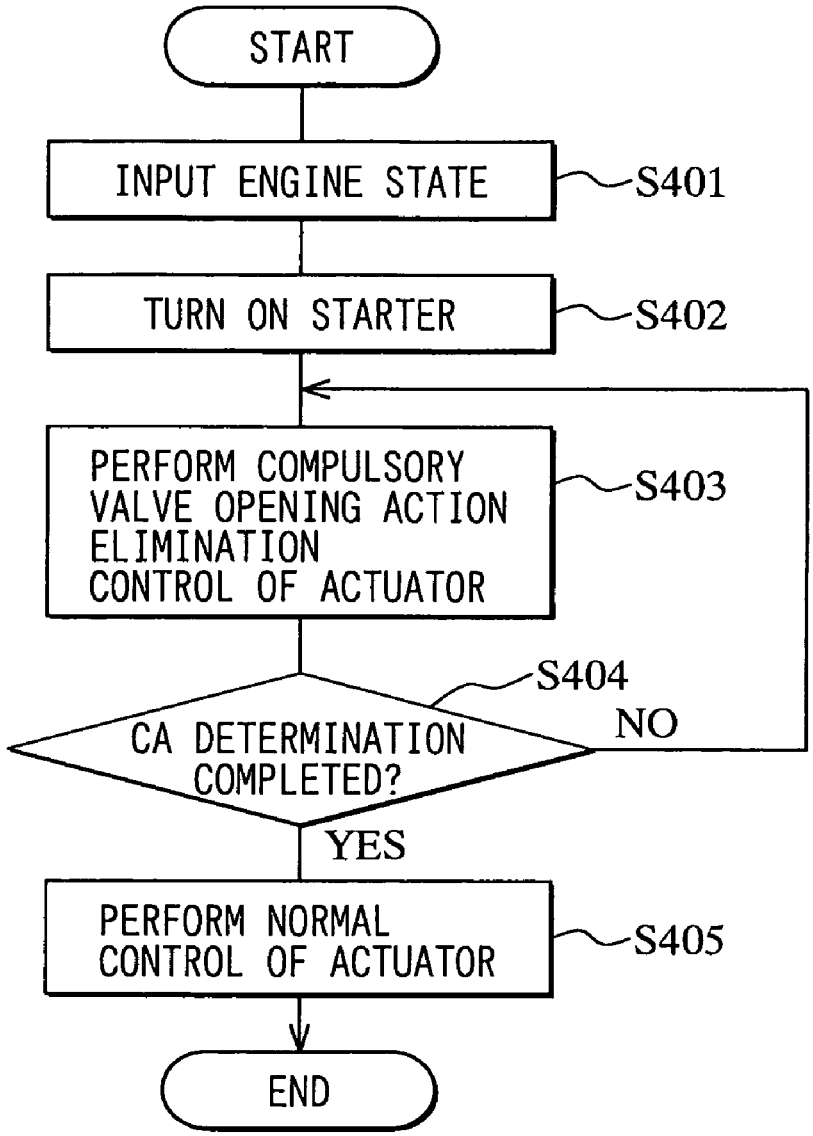
FIG. 13 is a flowchart showing processing steps of a starting period high-pressure pump control program according to a seventh embodiment of the present invention.

The fuel supply system of the seventh embodiment executes a starting period high-pressure pump control program shown by a flowchart of FIG. 13. Thus, the fuel supply system performs the compulsory valve opening action elimination control for holding the electromagnetic actuator 45 at the compulsory opening action elimination position when the crank angle cannot be sensed before the completion of the crank angle determination during the engine starting period. The fuel supply system performs normal control for switching the electromagnetic actuator 45 between the compulsory valve opening position and the compulsory valve opening action elimination position when the crank angle determination is completed so that the crank angle can be sensed.

If the starting period high-pressure pump control program shown by the flowchart of FIG. 13 is started, the engine state is inputted in Step S401, first. Then, in Step S402, the starter is turned on to start the engine. Then, in Step S403, the compulsory valve opening action elimination control for holding the electromagnetic actuator 45 at the compulsory valve opening action elimination position is started in Step S403.

Then, in Step S404, it is determined whether the crank angle determination is completed. If the result of the determination in Step S404 is "NO", it is determined that the crank angle CA (the phase of the pump cam 33) cannot be sensed yet, and the compulsory valve opening action elimination control of the electromagnetic actuator 45 is continued.

It is determined that the crank angle CA (the phase of the pump cam 33) can be sensed at the time when it is determined that the crank angle determination is completed in Step S404. Then, the ECU 26 proceeds to Step S405. In Step S405, the normal control of the electromagnetic actuator 45 is started.

The fuel supply system of the seventh embodiment performs the compulsory valve opening action elimination control for holding the electromagnetic actuator 45 at the compulsory valve opening action elimination position when the crank angle CA cannot be sensed before the completion of the crank angle determination during the engine starting period. Therefore, the fuel supplied from the low-pressure pump 12 can be pressurized and supplied to the delivery pipe 19 by the high-pressure pump 42 with the use of the check valve 43 of the suction passage 27. Thus, the atomization of the injected fuel can be promoted and the combustibility can be improved from the early stage of the engine starting period. As a result, the engine starting performance and the exhaust emission can be improved.

The seventh embodiment may be used in combination with the sixth embodiment.

The fuel supply system of the sixth or seventh embodiment holds the electromagnetic actuator 45 at the compulsory valve opening action elimination position by continuously supplying the driving current Iv at the current value Ia, which is equal to the current value Ia of the driving current Iv in the normal control, to the electromagnetic actuator 45 during the compulsory valve opening action elimination control of the electromagnetic actuator 45. Alternatively, the electromagnetic actuator 45 may be held at the compulsory opening action elimination position by continuously supplying the driving current Iv at a current value Ib, which is lower than the current value Ia in the normal control. Alternatively, the electromagnetic actuator 45 may be held at the compulsory valve opening action elimination position by performing the duty cycle control of the driving current Iv of the electromagnetic actuator 45 for setting an average value Ic of the driving current Iv to a value, which is lower than the driving current value Ia in the normal control.

Eighth Embodiment

Figure 14:
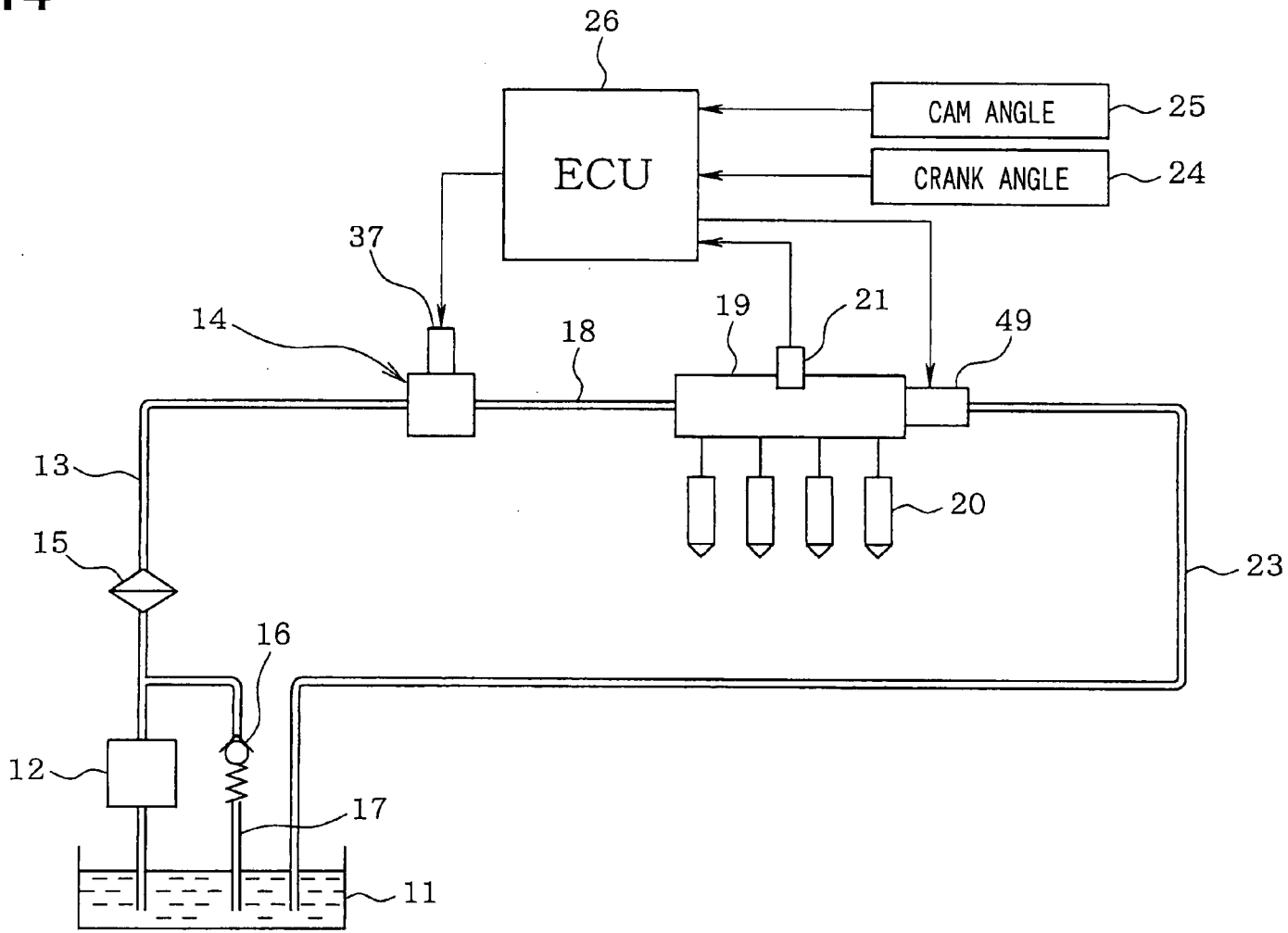
FIG. 14 is a schematic diagram showing a fuel supply system of an internal combustion engine according to an eighth embodiment of the present invention.

Next, a fuel supply system according to an eighth embodiment of the present invention will be explained based on FIG. 14.

In the fuel supply system according to any one of the first to seventh embodiments, the mechanical high-pressure regulator 22, of which the valve opening pressure is fixed at the constant value, is connected to the delivery pipe 19. In the fuel supply system of the eighth embodiment, an electromagnetic high-pressure regulator 49, of which a valve opening pressure can be changed arbitrarily, is connected to the delivery pipe 19 as shown in FIG. 14. Thus, the fuel pressure in the delivery pipe 19 (the pressure of the fuel supplied to the fuel injection valves 20) can be controlled by controlling the valve opening pressure of the high-pressure regulator 49 during the valve closing control of the electromagnetic valve 37 (or the compulsory valve opening action elimination control of the electromagnetic actuator 45).

The fuel supply system of each one of the first to eighth embodiments performs the valve closing control of the electromagnetic valve 37 (or the compulsory valve opening action elimination control of the electromagnetic actuator 45) when the engine rotation speed is equal to or lower than the idling rotation speed. Alternatively, the rotation speed range for performing the valve closing control of the electromagnetic valve 37 (or the compulsory valve opening action elimination control of the electromagnetic actuator 45) may be changed arbitrarily in accordance with the intensity of the engine sound or the travel noise. The valve closing control of the electromagnetic valve 37 (or the compulsory valve opening action elimination control of the electromagnetic actuator 45) may be performed when the engine rotation speed is equal to or lower than a predetermined value higher than the idling rotation speed.

In the above embodiments, the valve closing control of the electromagnetic valve 37 (or the compulsory valve opening action elimination control of the electromagnetic actuator 45) is performed when the crank angle cannot be sensed before the completion of the crank angle determination during the engine starting period. Alternatively, the valve closing control of the electromagnetic valve 37 (or the compulsory valve opening action elimination control of the electromagnetic actuator 45) may be performed when the crank angle cannot be sensed due to a failure of the crank angle sensor 24 and the like during the operation of the engine.

In addition to the high-pressure pump of the direct injection type gasoline engine, the present invention can be applied to various types of high-pressure pumps of engines such as any other types of gasoline engines or diesel engines.

The present invention should not be limited to the disclosed embodiments, but may be implemented in many other ways without departing from the spirit of the invention.

What is claimed is:

1. A fuel supply system of an internal combustion engine, the fuel supply system comprising:

a high-pressure pump, which includes a pump chamber provided between a fuel suction passage and a fuel discharge passage, a plunger reciprocating in the pump chamber for suctioning and discharging fuel, and an electromagnetic valve for opening and closing the fuel suction passage;

pump controlling means for controlling a fuel discharge quantity of the high-pressure pump by controlling opening timing and closing timing of the electromagnetic valve with respect to the reciprocating movement of the plunger;

a secondary suction passage, which branches from the fuel suction passage and communicates with the pump chamber; and a check valve disposed in the secondary suction passage, wherein the pump controlling means performs valve closing control for holding the electromagnetic valve at a closed state when a rotation speed of the engine is equal to or lower than a predetermined value.

2. The fuel supply system as in claim 1, wherein the secondary suction passage is formed with a restriction passage portion, of which a passage sectional area is narrowed.

3. The fuel supply system as in claim 1, wherein the pump controlling means holds the electromagnetic valve at the closed state with a driving current, which is lower than the driving current in normal control, when the pump controlling means performs the valve closing control.

4. The fuel supply system as in claim 3, wherein the pump controlling means sets an average value of the driving current of the electromagnetic valve to a value, which is lower than the driving current in the normal control, by performing duty cycle control of the driving current when the pump controlling means performs the valve closing control.

5. A fuel supply system of an internal combustion engine, the fuel supply system comprising:

a high-pressure pump, which includes a pump chamber provided between a fuel suction passage and a fuel discharge passage, a plunger reciprocated in the pump chamber by a power of the engine for suctioning and discharging fuel, and an electromagnetic valve for opening and closing the fuel suction passage;

pump controlling means for controlling a fuel discharge quantity of the high-pressure pump by controlling opening timing and closing timing of the electromagnetic valve with respect to the reciprocating movement of the plunger;

a secondary suction passage, which branches from the fuel suction passage and communicates with the pump chamber; and a check valve disposed in the secondary suction passage, wherein the pump controlling means performs valve closing control for holding the electromagnetic valve at a closed state when a crank angle of the engine cannot be sensed.

6. The fuel supply system as in claim 5, wherein the pump controlling means holds the electromagnetic valve at the closed state with a driving current, which is lower than the driving current in normal control, when the pump controlling means performs the valve closing control.

7. The fuel supply system as in claim 6, wherein the pump controlling means sets an average value of the driving current of the electromagnetic valve to a value, which is lower than the driving current in the normal control, by performing duty cycle control of the driving current when the pump controlling means performs the valve closing control.

8. A fuel supply system of an internal combustion engine, the fuel supply system comprising:

a high-pressure pump, which includes a pump chamber provided between a fuel suction passage and a fuel discharge passage, a plunger reciprocating in the pump chamber for suctioning and discharging fuel, and an electromagnetic actuator for switching between a valve opening position for compulsorily opening a check valve disposed in the fuel suction passage and a compulsory valve opening action elimination position for eliminating the compulsory valve opening action of the check valve; and pump controlling means for controlling a fuel discharge quantity of the high-pressure pump by controlling the electromagnetic actuator and by controlling opening timing and closing timing of the check valve with respect to the reciprocating movement of the plunger, wherein the pump controlling means performs compulsory opening action elimination control for holding the electromagnetic actuator at the compulsory opening action elimination position when a rotation speed of the engine is equal to or lower than a predetermined value.

9. The fuel supply system as in claim 8, wherein the pump controlling means holds the electromagnetic actuator at the compulsory valve opening action elimination position with a driving current, which is lower than the driving current in normal control, when the pump controlling means performs the compulsory valve opening action elimination control.

10. The fuel supply system as in claim 9, wherein the pump controlling means sets an average value of the driving current of the electromagnetic actuator to a value, which is lower than the driving current in the normal control, by performing duty cycle control of the driving current when the pump controlling means performs the compulsory valve opening action elimination control.

11. A fuel supply system of an internal combustion engine, the fuel supply system comprising:

a high-pressure pump, which includes a pump chamber provided between a fuel suction passage and a fuel discharge passage, a plunger reciprocated in the pump chamber by a power of the engine for suctioning and discharging fuel, and an electromagnetic actuator for switching between a valve opening position for compulsorily opening a check valve disposed in the fuel suction passage and a compulsory valve opening action elimination position for eliminating the compulsory valve opening action of the check valve; and pump controlling means for controlling a fuel discharge quantity of the high-pressure pump by controlling the electromagnetic actuator and by controlling opening timing and closing timing of the check valve with respect to the reciprocating movement of the plunger, wherein the pump controlling means performs compulsory valve opening action elimination control for holding the electromagnetic actuator at the compulsory valve opening action elimination position when a crank angle of the engine cannot be sensed.

12. The fuel supply system as in claim 11, wherein the pump controlling means holds the electromagnetic actuator at the compulsory opening action elimination position with a driving current, which is lower than the driving current in normal control, when the pump controlling means performs the compulsory valve opening action elimination control.

13. The fuel supply system as in claim 12, wherein the pump controlling means sets an average value of the driving current of the electromagnetic actuator to a value, which is lower than the driving current in the normal control, by performing duty cycle control of the driving current when the pump controlling means performs the compulsory valve opening action elimination control.

* * * * *